US006354198B1

(12) United States Patent
Endo

(10) Patent No.: US 6,354,198 B1
(45) Date of Patent: Mar. 12, 2002

(54) FOIL PRINTER CAPABLE OF PRINTING FOIL CHARACTERS AND/OR DIAGRAMS WITH ONE HAND

(75) Inventor: Seiji Endo, Minami-Kawara-mura (JP)

(73) Assignee: Sunshine Co., Ltd., Osaka (JP)

( * ) Notice: Subject to any disclaimer, the term of this patent is extended or adjusted under 35 U.S.C. 154(b) by 0 days.

(21) Appl. No.: 09/537,887

(22) Filed: Mar. 29, 2000

(51) Int. Cl.[7] ..... B05C 1/16

(52) U.S. Cl. ..... 101/35; 118/76; 118/77; 118/257

(58) Field of Search ..... 101/4, 33, 158, 101/34, 35; 400/88, 697; 118/257, 76, 77, 78; 347/212

(56) References Cited

U.S. PATENT DOCUMENTS 2,918,189 A * 12/1959 Frohbach et al. ..... 216/20
4,511,427 A * 4/1985 Karliner et al. ..... 156/523
5,135,798 A * 8/1992 Muschter et al. ..... 428/202
5,379,477 A * 1/1995 Tamai et al. ..... 15/104.94
5,490,898 A * 2/1996 Koyama ..... 156/540
5,556,469 A * 9/1996 Koyama et al. ..... 118/257
5,723,168 A * 3/1998 Swain et al. ..... 427/11
5,759,270 A * 6/1998 Lee ..... 118/257
D410,955 S * 6/1999 Hoffmann ..... D19/69

FOREIGN PATENT DOCUMENTS

JP 4926008 3/1974
JP 62240550 10/1987

* cited by examiner

*Primary Examiner*—John S. Hilten
*Assistant Examiner*—Kevin D. Williams
(74) *Attorney, Agent, or Firm*—Webb Ziesenheim Logsdon Orkin & Hanson, P.C.

(57) ABSTRACT

There is provided a handy type foil printer capable of performing printing operation easily with one hand and achieving an effective use of a print film. A film roll is accommodated detachably within a casing that is sized to be operable by one hand and has an opening for printing. The film roll is a print film that consists of a base film and a foil removably adhered thereon and is processed in the form of a long tape and rolled. A printing roller is arranged at the opening, exposing a part of its circumferential surface. The print film drawn out from the film roll is wound by a winding roller via the outer circumferential surface of the printing roller. Holding the casing in one hand, pressing and rotating the printing roller on the original character and/or diagram depicted with an adhesive ink can print the foil on the character and/or diagram.

4 Claims, 3 Drawing Sheets

FOIL PRINTER CAPABLE OF PRINTING FOIL CHARACTERS AND/OR DIAGRAMS WITH ONE HAND

BACKGROUND OF THE INVENTION

1. Field of the Invention

The present invention relates to a handy type foil printer for printing decorative characters and/or diagrams with a gold foil and the like.

2. Description of the Related Art

There has been a technology that employs a print film consisting of a base film and a foil removably adhered thereon and transfers the foil from the print film to a material to be printed, such as paper and plastic. The technology is known as a method of printing decorative characters and/or diagrams with a metallic foil made of gold, silver or aluminum and a pigment foil. Original characters and/or diagrams are previously depicted on the material with an adhesive ink on which the print film is thereafter pressed to transfer the foil so that glossy or colorful foil characters and/or diagrams can be printed (see JPA 49-26008 and JPA 62-240550, for example).

Various print films for use in printing such the foil characters and/or diagrams have already been available commercially. They are used for decorating confectionery packaging paper and containers. They are also used for labels, seals and bar codes to be attached on various products such as books, cosmetics and AV equipment cabinets. Printers for printing the foil characters and/or diagrams manually or automatically have also been to the commercial stage.

No compact printer has become commercially practical, however, for the personal use of such the print film. In case of printing characters and/or diagrams personally on various goods, gifts and cards, original characters and/or diagrams are required to be depicted with an adhesive ink and then the print film must be overlapped and pressed downwardly onto them. In such the case, it is difficult for children, since the print film is thin, to overlap the film on the adhesive without wrinkling the film. The print film can not be reused at its parts after the foil is once removed from the parts. Accordingly, a print film that is formed as a sheet, for example, becomes gradually spotted after printing is performed several times. The printing operation with such the film is not always easy because it is performed along with selecting foil-remaining parts. It is also difficult to print beautifully. The foil on the print film remains in a worm-eaten state and can not be used any more. This prevents an effective use of the film.

SUMMARY OF THE INVENTION

The present invention has been made in consideration of such the situations and accordingly has an object to provide a handy type foil printer capable of performing a printing operation easily with one hand without wrinkling a print film as well as achieving an effective use of the print film.

The present invention is provided with a foil printer which comprises a casing sized to be operable with one hand and a film roll detachably accommodated within the casing. The film roll is a print film processed in the form of a long tape and rolled. The print film consists of a base film and a foil removably adhered thereon. The foil printer also comprises a winding roller arranged within the casing for winding the print film drawn out from the film roll. The foil printer further comprises a printing section formed between the film roll and the winding roller for exposing the print film outside the casing in order to allow the print film to press on a material to be printed. The casing is held in one hand to press the printing section on the material, thereby printing the foil on a character and/or diagram depicted on the material with an adhesive ink.

The present invention is also provided with a foil printer which comprises a casing sized to be operable with one hand. The casing has an opening as a printing section. The foil printer also comprises a film roll accommodated rotatably within the casing, exposing part of a circumferential surface of the film roll through the opening. The film roll is a print film processed in the form of a long tape and rolled. The print film consists of a base film and a foil removably adhered thereon. The casing is held in one hand to press the film roll exposed through the opening on the material, thereby printing the foil on a character and/or diagram depicted on the material with an adhesive ink.

According to the present invention, printing the foil character and/or diagram can be performed easily without wrinkling the film by holding the casing in one hand, needless to take the print film directly by hand. The print film is wound in the form of a roll and is drawn out in accordance with the operation of the casing. The foil can be transferred onto the material to be printed during the film rotates on the material. Therefore, controlling an amount of a print film to be drawn can make it possible to feed a new print film surface in turn so as to remain less residual foil at used parts, thereby achieving an effective use of the print film.

Other features and advantages of the invention will be apparent from the following description of the preferred embodiments thereof.

BRIEF DESCRIPTION OF THE DRAWINGS

The present invention will be more fully understood from the following detailed description with reference to the accompanying drawings in which.

DETAILED DESCRIPTION OF THE PREFERRED EMBODIMENTS

Figure 1:
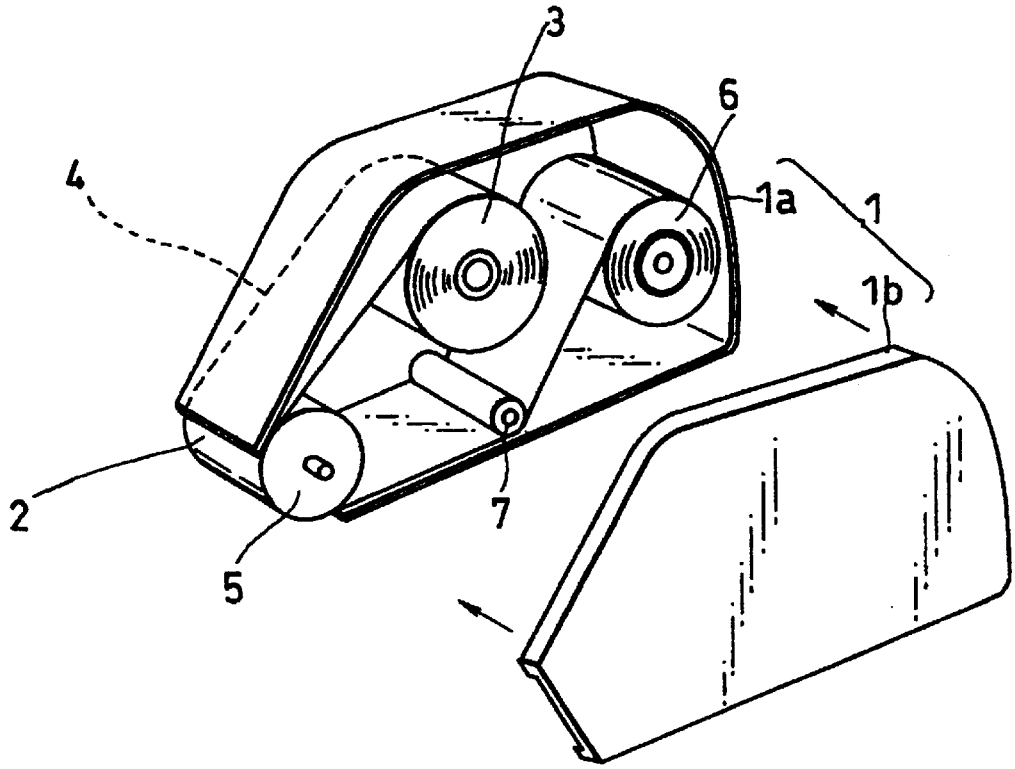
FIG. 1 is a disassembled perspective view illustrating an embodiment of a handy type foil printer according to the present invention.

FIG. 1 is a disassembled perspective view illustrating an embodiment of a handy type foil printer according to the present invention. A casing 1 is made of a plastic material, for example, and comprises a casing body 1*a* and a cover 1*b*. The casing 1 has a thickness of about 1–3 cm and is processed to a small size enough to be held in one hand. A rectangular opening 2 for printing is formed at the front-end portion of the casing 1. A printing roller 5 is arranged at the opening 2 in a state that a part of its circumferential surface is exposed.

A film roll 3 is removably loaded within the casing 1. The film roll 3 comprises a print film 4 that is processed in the form of a long tape with a width of 1–3 cm and rolled. The print film 4 consists of a base film and a decorative foil such as a gold foil and a hologram foil removably adhered on the base film. The print film 4 drawn out from the roll 3 is put around the printing roller 5 so as to expose in the rectangular opening 2 and is then wound by a winding roller 6 via an auxiliary roller 7.

Figure 2:
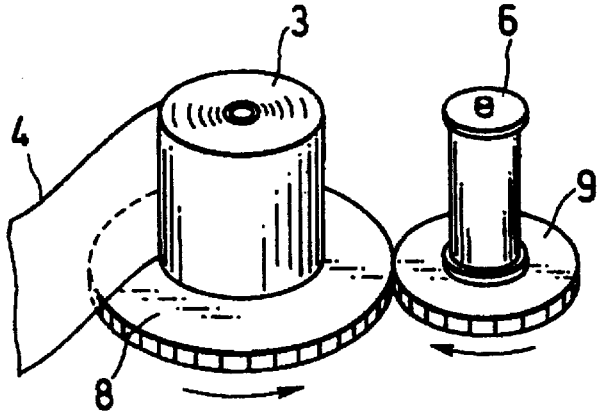
FIG. 2 is a perspective view showing an interlock mechanism between a film roll and a winding roller in the printer of FIG. 1.

The film roll 3 and winding roller 6 rotate in the opposite directions to each other by gears 8 and 9 that mesh with each other and are mounted on a side of the casing body 1*a* as shown in FIG. 2. Thus, if pressing the printing roller 5 on a material to be printed and rotating the roller in one direction, the print film 4 can be drawn out of the roll 3 and wound around the winding roller 6. If rotating the roller 5 in the opposite direction, the film 4 can be rewound.

Figure 3A:
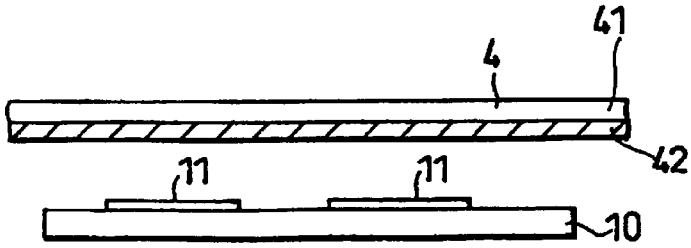
FIGS. 3A and 3B are diagrams for explaining the principle of foil printing according to the printer of FIG. 1.
Figure 3B:
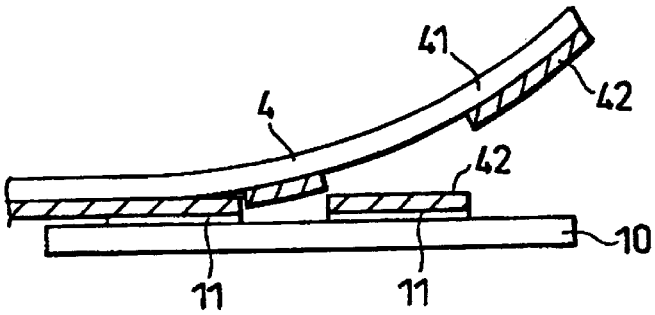

FIGS. 3A and 3B are diagrams for explaining the principle of foil printing with the print film 4. The print film 4 is made of a base film 41 and a foil 42. The foil 42 is adhered on and easily removable from the base film 41. A character and/or diagram is previously printed with an adhesive ink 11 on a material 10 such as paper, plastic and others to be printed as shown in FIG. 3A. When the print film 4 is pressed onto and then peeled from the preliminary printed material 10, the foil 42 can be transferred onto the character and/or diagram as shown in FIG. 3B.

The base film 41 is made of polyester or cellophane, for example. The adhesive ink 11 is, for example, an emulsion that is composed of a water-insoluble acrylic resin dispersed in an aqueous medium. If the color ink is used as the adhesive ink 11, a range for printing and an area left not printed can become definite and thus print failures can be decreased. In case of using the hologram film as the foil 42, even if retrying to print the same portion when the previous printing is not complete, useless patterns are not produced.

Figure 4:
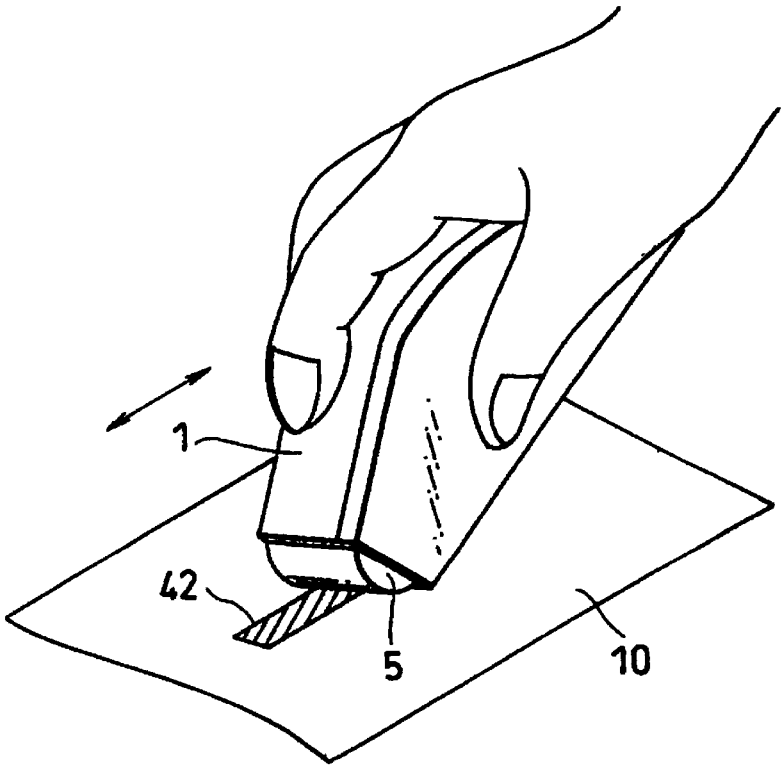
FIG. 4 is a perspective view showing an operation of the printer of FIG. 1.

FIG. 4 shows an embodied operation of foil printing on the material 10 using the printer of FIG. 1. The casing 1 is held in one hand as shown in the figure. Then, the printing roller 5, around which the print film 4 is put, is pressed onto the material 10 so as to trace the characters and/or diagrams preliminary printed thereon and is rotated back and forth to perform foil printing.

Such the handy type printer configuration that accommodates the film roll can realize foil printing with an easy operation needless to handle the print film directly by hand. Shifting the printing roller 5 little by little to the left or right during it rotates back and forth to trace the preliminary printed characters and/or diagrams enables to utilize the printing film 4 effectively also in its width direction. If the foil is not left at the exposed portion, drawing out a new part of the printing film 4 and performing a similar printing operation may employ the printing film 4 completely without wasting it.

Figure 5:
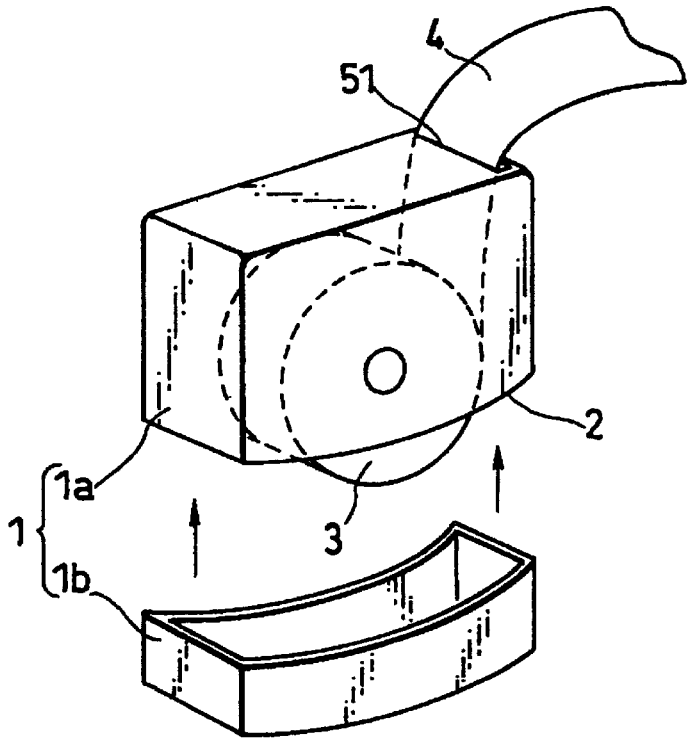
FIG. 5 is a disassembled perspective view illustrating another embodiment of a handy type foil printer according to the present invention.

FIG. 5 is a disassembled perspective view illustrating another embodiment of a handy type foil printer having a simplified structure according to the present invention. A film roll 3 in this embodiment, which is similar to that in the embodiment shown in FIG. 1, is accommodated rotatably within a casing 1. The casing has an opening 2 for printing and is sized to be operable with one hand, exposing part of a circumferential surface of the film roll through the opening 2. The casing 1 also has an outlet 51 through which a used print film 4 is drawn out.

The cover 1*b* of the casing 1 in case of FIG. 1 is closed even when the printer is in service, and is opened only at the time of changing the film roll 3. To the contrary, a cover 1*b* in case of FIG. 5 is used for closing the opening 2 during the printer is not in service, and is removed when the printer is in service.

This configuration can also achieve the same effect as that of the printer of FIG. 1. In addition, this configuration has an advantage that enables to manufacture a simpler printer with a lower cost than that of the printer of FIG. 1.

Figure 6:
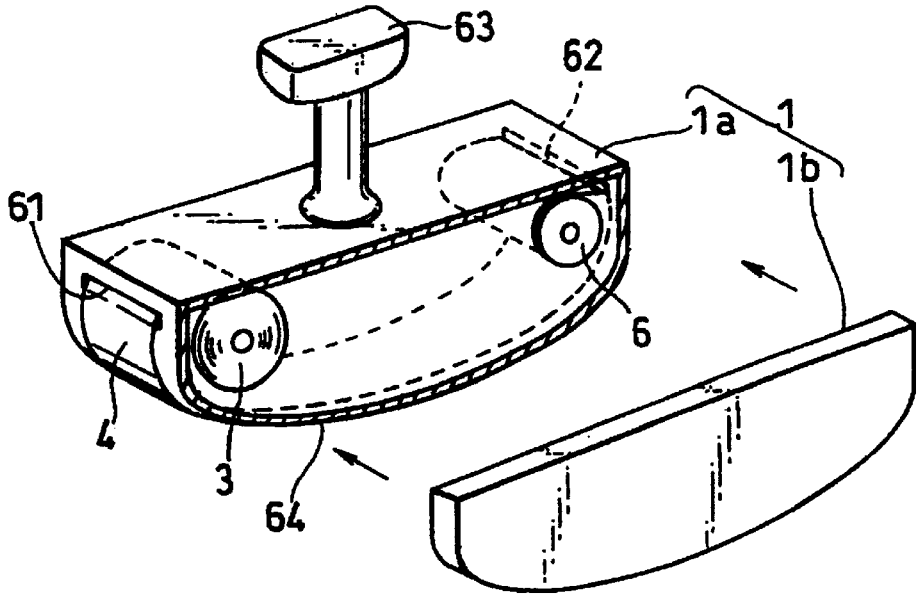
FIG. 6 is a disassembled perspective view illustrating a further embodiment of a handy type foil printer according to the present invention.

FIG. 6 is a perspective view illustrating a further embodiment of a handy type foil printer according to the present invention. A casing 1 in this embodiment is semi-circular and has a substantially flat rectangular upper surface, and a lower surface that describes a slow circular arc. A film roll 3 and a winding roller 6 are accommodated within the casing 1 at one and the other end portions, respectively. Slits 61 and 62 are formed at the both end portions of the casing 1. A print film 4, which is put around from the film roll 3 to the winding roller 6, is exposed through the slits 61 and 62 outside the casing 1 that describes the circular arc. Such the exposed part of the print film 4, which tightly contacts with the outer surface of the casing 1 and describes a circular arc, forms a printing section 64. A handle 63 is provided on the upper flat surface in order to ease operations.

In this printer, pressing and rotating the printing section 64, which describes the circular arc, on a range where characters and/or diagrams are preliminary printed can achieve foil printing. In case of the printer of FIG. 1, the film roll 3 may automatically feed out and rewind the film when the printing roller 5 rotates for printing. To the contrary, in case of the printer of FIG. 6, the print film 4 can not be drawn out and rewound if rotating it without scraping. Therefore, a winding knob (not depicted) may be provided, for example, on the axis of the winding roller 6 for winding used parts of the film in turn.

This configuration can also achieve the same effects as those of the printers of FIGS. 1 and 5.

According to the present invention, a handy type foil printer capable of performing a printing operation easily with one hand without wrinkling a print film as well as achieving an effective use of the print film can be provided as describe above.

Having described the embodiments consistent with the present invention, other embodiments and variations consistent with the present invention will be apparent to those skilled in the art. Therefore, the invention should not be viewed as limited to the disclosed embodiments but rather should be viewed as limited only by the spirit and scope of the appended claims.

What is claimed is:

1. A foil printer for printing indicia on a material in a process wherein the indicia is first printed with an adhesive ink on the surface of the material to be printed and thereafter the foil is transferred from a tape to the adhesive ink by pressing the tape against the adhesive ink, said foil printer comprising:

a casing sized to be operable with one hand;

a film roll detachably accommodated within said casing, said film roll being a print film processed in the form of a long rolled tape, said print film consisting of a base film and a foil removably adhered thereon;

a winding roller arranged within said casing for winding said print film drawn out from said film roll; and a printing section comprising a support surface formed between said film roll and said winding roller for exposing said print film outside said casing in order to allow said print film to press on the material to be printed, said support surface being the surface of a roller journaled in the casing, wherein said casing is held in one hand to press said printing section on said material, thereby printing said foil on indicia depicted on said material with an adhesive ink.

2. A foil printer for printing indicia on a material in a process wherein the indicia is first printed with an adhesive ink on the surface of the material to be printed and thereafter the foil is transferred from a tape to the adhesive ink by pressing the tape against the adhesive ink, said foil printer comprising:

a casing sized to be operable by one hand, said casing having an opening as a printing section;

a film roll accommodated rotatably within said casing, exposing part of a circumferential surface of said film roll through said opening, said film roll being a print film processed in the form of a long tape and rolled, said print film consisting of a base film and a foil removably adhered thereon; and a printing section comprising a support surface, said support surface being the circumferential surface of said film roll, wherein said casing is held in one hand to press said film roll exposed through said opening on said material, thereby printing said foil on indicia depicted on said material with an adhesive ink.

3. A method for printing foil indicia with a foil tape by use of a hand held foil printer, comprising:

a step for preliminary printing of indicia with an adhesive ink on a material to be printed; and a step for pressing said foil tape onto said material so as to print foil indicia where the adhesive ink has been printed, wherein said tape is dispersed from a foil printer comprising:

a casing sized to be operable with one hand;

a film roll detachably accommodated within said casing, said film roll being a print film processed in the form of a long rolled tape, said print film consisting of a base film and a foil removably adhered thereon;

a winding roller arranged within said casing for winding said print film drawn out from said film roll; and a printing section comprising a support surface formed between said film roll and said winding roller for exposing said print film outside said casing in order to allow said print film to press on a material to be printed, said support surface being the surface of a roller journaled in the casing, wherein said casing is held in one hand to press said printing section on said material, thereby printing said foil on indicia depicted on said material with an adhesive ink.

4. A method for printing foil indicia with a foil tape by a foil printer, comprising:

a step for preliminary printing of indicia with an adhesive ink on a material to be printed; and a step for pressing said foil printer onto said material so as to trace said indicia preliminary printed thereon, wherein said foil printer comprises:

a casing sized to be operable by one hand, said casing having an opening as a printing section;

a film roll accommodated rotatably within said casing, exposing part of a circumferential surface of said film roll through said opening, said film roll being a print film processed in the form of a long tape and rolled, said print film consisting of a base film and a foil removably adhered thereon; and a printing section comprising a support surface, said support surface being the circumferential surface of said film roll, wherein said casing is held in one hand to press said film roll exposed through said opening on said material, thereby printing said foil on said indicia depicted on said material with an adhesive ink.

* * * * *